United States Patent [19]

Tahara et al.

[11] Patent Number: 4,633,693

[45] Date of Patent: Jan. 6, 1987

[54] METHOD OF CONTROLLING THE STRIP SHAPE AND APPARATUS THEREFOR

[75] Inventors: Akihiro Tahara, Osaka; Katsuya Kondo, Amagasaki, both of Japan

[73] Assignee: Sumitomo Metal Industries, Ltd., Osaka, Japan

[21] Appl. No.: 716,766

[22] Filed: Mar. 27, 1985

[30] Foreign Application Priority Data

Mar. 29, 1984 [JP] Japan ..... 59-63071

[51] Int. Cl.[4] ..... B21B 37/02

[52] U.S. Cl. ..... 72/8; 72/16; 72/17; 72/20; 72/201; 72/243; 72/245; 364/472

[58] Field of Search ..... 72/245, 243, 17, 16, 72/20, 8, 201; 364/472

[56] References Cited

U.S. PATENT DOCUMENTS

| | | | |
|---|---|---|---|
| 4,269,051 | 5/1981 | Clarke et al. | 72/17 X |
| 4,392,367 | 7/1983 | Bald | 72/17 X |
| 4,445,349 | 5/1984 | Eibe | 72/17 |
| 4,458,515 | 7/1984 | Imai | 72/243 X |
| 4,537,050 | 8/1985 | Bryant et al. | 72/201 X |

*Primary Examiner*—Francis S. Husar
*Assistant Examiner*—Steve Katz
*Attorney, Agent, or Firm*—Burns, Doane, Swecker & Mathis

[57] ABSTRACT

Controlling for obtaining the aimed strip shape using a rolling mill provided with rolls, which are variable in amount of crown by feeding a pressurized oil in the inside. In addition, the rolling mill is provided with right and left pressing-down balancers and roll benders. The strip shape in the width direction of the strip is detected, the detected shape being approximated by a function including terms of the first, second, fourth, sixth or eighth power of a variable, which is a position or a distance in the width direction of the strip, the amount of pressing-down of the right and left pressing-down balancers being adjusted to coincide the term of the first power with the aimed value thereof, the amount of crown of the roll being adjusted to coincide the term of the second power with the aimed value thereof, and a roll bending force being adjusted to coincide the term of the fourth, sixth or eighth power with the aimed value thereof.

5 Claims, 18 Drawing Figures

METHOD OF CONTROLLING THE STRIP SHAPE AND APPARATUS THEREFOR

BACKGROUND OF THE INVENTION

1. Field of the Invention

The present invention relates to a method of controlling the shape of iron or nonferrous metals strip and an apparatus therefor.

Herein, the strip shape designates a surface shape of strip such as a center buckle (the state where the central portion of the strip in the width direction thereof is stretched longer than the side edge portion thereof) and a wavy edge (the state wherein the side edge portion of the plate in the width direction thereof is stretched longer than the central portion thereof), in particular a strip shape appearing in the width direction of the strip. Since the strip is subjected to a tension by means of a rolling-mill and pinch-rolls in the rolling process, the strip shape does not appear according to circumstances. The shape corresponds to a tensile stress given to each portion of the strip in the width direction thereof in the rolling process. That is to say, the portion, on which a larger tensile stress is given, corresponds to the portion of which elongation is small, and v.v., and the shape is determined depending on such an elongation. Accordingly, means for measuring the shape, in short, a shape meter is constructed to measure a tensile stress at a large number of points of the strip being rolled in the width direction thereof.

2. Prior Art

The shape is remarkably important for the evaluation of the quality of the strip. A rolling mill, which is capable of controlling the strip shape, is disclosed in U.S. Pat. No. 4,269,051 (Clark et al.). This rolling mill is provided with a detector for detecting the tension, in short, abovementioned tensile stress downstream thereof and a signal obtained by the detector is used for controlling the strip shape. Summarizing Clark et al.'s invention in order to make the comparison of the invention with the present invention easy, the shape is approximated by $a+bx+cx^2$ on the basis of an output signal from the detector, wherein x is a variable designating a distance from the center of the strip in the width direction thereof; a, b and c is a constant, respectively.

Although it is desired that the strip shape is flat, but the aimed strip shape which is desired in the rolling process is not flat, in short, it is not expressed by only the constant a excepting bx and $cx^2$ in the above described formula. It is the reason of the above described that an influence of heat is given to the strip in the rolling process, the strip shape being detected by the tensile stress, and the tensile stress being different at end portions and the central portion of the strip in the width direction thereof even though the strip shape is identical. So, the shape aimed in the rolling process is expressed by a parabolical equation of x, and right and left pressing-down balancers for adjusting the leveling of roll gap, a roll-bender and a roll-cooling apparatus are controlled to coincide a quadratic equation $(a+b+cx^2)$ of the measured shape with the parabolical equation of the aimed shape. That is to say, according to Clark et al.'s invention, a term of the first power of x is controlled by the right and left pressing-down balancer and a quadratic term of x is controlled by the roll-bender and the roll-cooling apparatus.

In short, a rolling mill according to Clark et al.'s invention is ineffective for a complex shape defect appearing by compounding various forms of stretch at all. It is perhaps the reason of the above described that a parabolical equation approximating the strip shape is insufficient, the control of the strip shape by the roll-cooling apparatus being slow in response, whereby being ineffective for the control of the complex shape defect, and the like. In addition, since the strip shape is greatly dependent upon the control by said roll-cooling apparatus and the control of the shape by the roll-cooling apparatus is slow in response, it can not be said that the controlling accuracy is high even for a simple stretch. Furthermore, since it is necessary to stabilize a temperature of mill rolls to some extent, such disadvantages as the necessity of a warming up rolling are found.

OBJECT OF THE INVENTION

It is the first object of the present invention to provide a method of controlling the strip shape and an apparatus therefor in which the dependency of the shape control upon the control by cooling a roll can be reduced, the response of control being heightened, and the aimed at shape being obtained in high accuracy, whereby the quality of produced strip being able to be heightened.

It is the second object of the present invention to provide a method of controlling the strip shape and an apparatus therefor in which a simple stretch such as a center buckle and a wavy edge can be controlled in high response by the use of a variable crown roll.

It is the third object of the present invention to provide a method of controlling the strip shape and an apparatus therefor in which the control of the strip shape can be controlled in high accuracy by approximating the strip shape by a function including a term of the fourth power or more of a variable designating a distance from an optional point in the width direction of the strip.

It is the fourth object of the present invention to provide a method of controlling the strip shape and an apparatus therefor in which the complex shape defect can be effectively controlled by the use of a variable crown roll and a roll-bender.

It is the fifth object of the present invention to provide a method of controlling the strip shape and an apparatus therefor in which the response can be heightened and the warming up rolling is unnecessary by carrying out the main control by the use of a variable crown roll and a roll-bender and the fine control by a roll-cooling apparatus.

It is the sixth object of the present invention to provide a method of controlling the strip shape and an apparatus therefor in which the shape control can be simply carried out by controlling means having a relation well corresponding to each term of a function including power terms of the above described variable for approximating the strip shape.

Other objects of the present invention will be obvious from the following description with reference with the drawings.

BRIEF SUMMARY OF THE INVENTION

A method of controlling the strip shape of the present invention is basically characterized by comprising the steps of: detecting the strip shape; obtaining a power function approximating the detected strip shape, said power function having a variable which is a distance in the direction of width from an optional point of the strip and including a term of the second power of said variable; and adjusting the amount of the crown of the back-up roll to coincide the term of the second power with the aimed value thereof.

In addition, a method of controlling the strip shape and an apparatus therefor of the present invention is characterized by that the first power term of the power function is controlled by right and left pressing-down balancers, the second power term being controlled by an amount of crown of the back-up roll, as described above, and the fourth, sixth and eighth power terms being controlled by the roll-bender so as to coincide with the aimed value, respectively.

A method of controlling the strip shape and an apparatus for carrying out same will be concretely described below.

DETAILED DESCRIPTION OF THE INVENTION

Figure 1A:
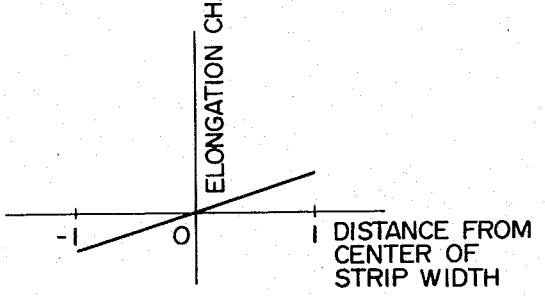
FIGS. 1 to 3 is a graph showing a characteristic of an elongation change of right and left pressing-down balancer, a variable crown roll and a roll-bender, respectively.
Figure 1B:
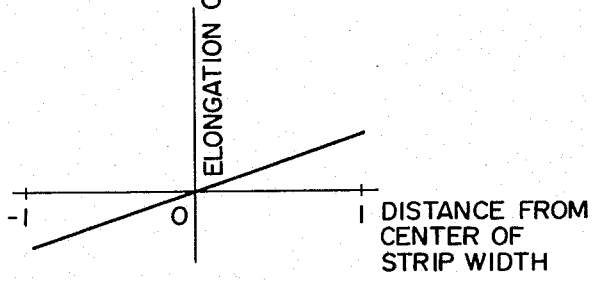
Figure 2A:
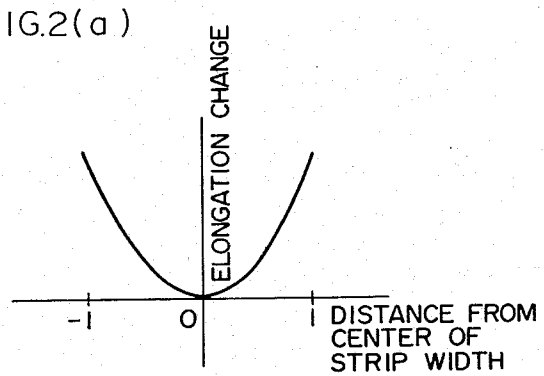
Figure 2B:
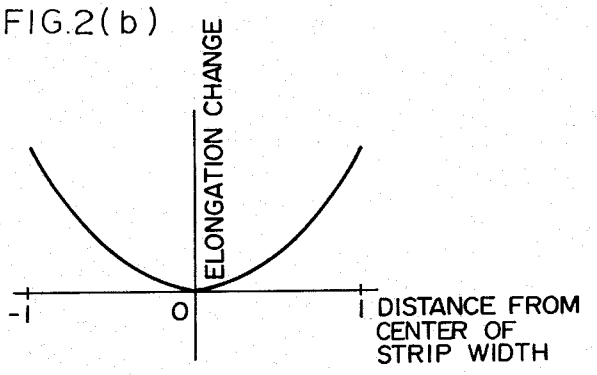
Figure 3A:
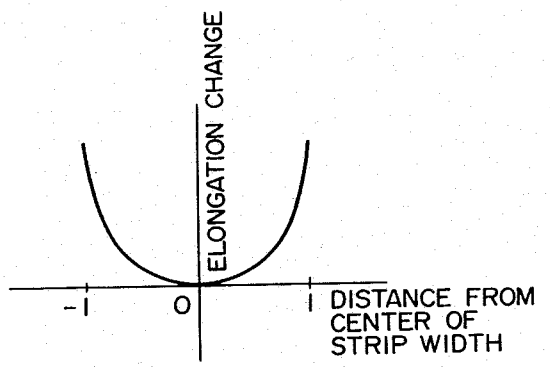
Figure 3B:
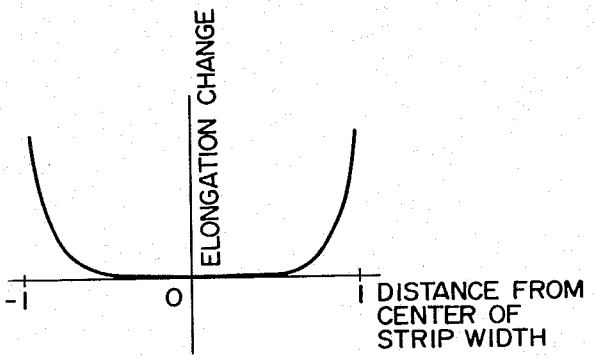

According to the present inventors' experiments, an elongation change of right and left pressing-down balancers which adjust the leveling of roll gap for controlling the strip shape, that of variable crown sleeve rolls expanding and shrinking a sleeve thereof by a pressurized oil (hereinafter referred to as VC roll) and that of roll benders are shown in FIGS. 1, 2 and 3, respectively. FIGS. 1(*a*), 2(*a*) and 3(*a*) and FIGS. 1(*b*), 2(*b*) and 3(*b*) show an elongation change when the right and left pressing-down balancers, the VC roll and the roll bender are independently applied to a narrow strip having a width of 1150 mm or less and a wide strip having a width of 1150 mm or more respectively. An axis of abscissas designates a distance x from the center of strip width (both side edge portions are designated as +1, −1) and an axis of ordinate designates an elongation change. As obvious from these graphs, the controlling characteristic of the right and left pressing-down balancers are expressed by an equation of the first power of x regardless of the strip width, the controlling characteristic of the VC roll being expressed by an equation of the second power of x, and the controlling characteristic of the roll bender being expressed by an equation of the fourth power of x for the narrow strip and an equation of the sixth power or eighth power of x for the wide strip.

Figure 4A:
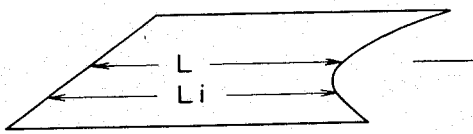
FIG. 4 is a diagram showing an elongation change.
Figure 4B:
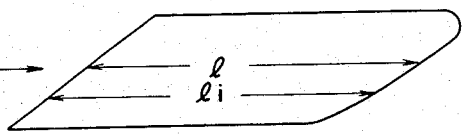

The elongation change is given by a difference between an elongation $E_i$ prior to the control and an elongation $\epsilon_i$ after the control of the right and left pressing-down balancers, the VC roll and the roll bender. FIGS. 4(*a*), 4(*b*) show the strip shape prior to and after the rolling. Each elongation $E_i$, $\epsilon_i$ is given by the following equations (1), (2):

$$E_i=(L-L_i)/L \quad (1)$$

$$\epsilon_i=(l-l_i)/l \quad (2)$$

wherein L, l are the length of base position, for example, strip width center, and $L_i$, $l_i$ are a length of another optional position.

Provided that the strip shape detected by a shape meter is expressed by g(x), a power function $f_i(x)$ as described by the following equation (3) is obtained by making g(x) correspond to an elongation change expressed by an equation of the first power of x, an equation of the second power of x and an equation of the fourth, sixth or eighth power of x designating the controlling characteristic of the pressing-down balancer, the VC roll and the roll bender, respectively.

$$f_i(x)=A_i+B_ix+C_i|x|^m+D_i|x|^n \quad (3)$$

wherein m, n are selected depending upon the milling condition and the materials of strip but m is 2 and n is 4, 6 or 8.

In addition, the aimed shape is determined and expressed by a power function $f_o(x)$ as described by the following equation (4) similarly to the above described:

$$f_o(x)=A_o+B_ox+C_o|x|^m+D_o|x|^n \quad (4)$$

The right and left pressing-down balancers are adjusted in pressing-down quantity to coincide $B_i$ of the term of the first power with the aimed value $B_o$, the pressurized oil of the VC roll being adjusted to coincide $C_i$ of the aimed of the second power with the target value $C_o$, and a force of the roll bender being adjusted to coincide $D_i$ of the term of the fourth, sixth or eighth power with the aimed value $D_o$ independently, respectively.

In addition, an ON-OFF control of each nozzle of a roll cooling apparatus is carried out to be obtained an elongation change corresponding to a difference between the g(x) and the $f_i(x)$.

Figure 5:
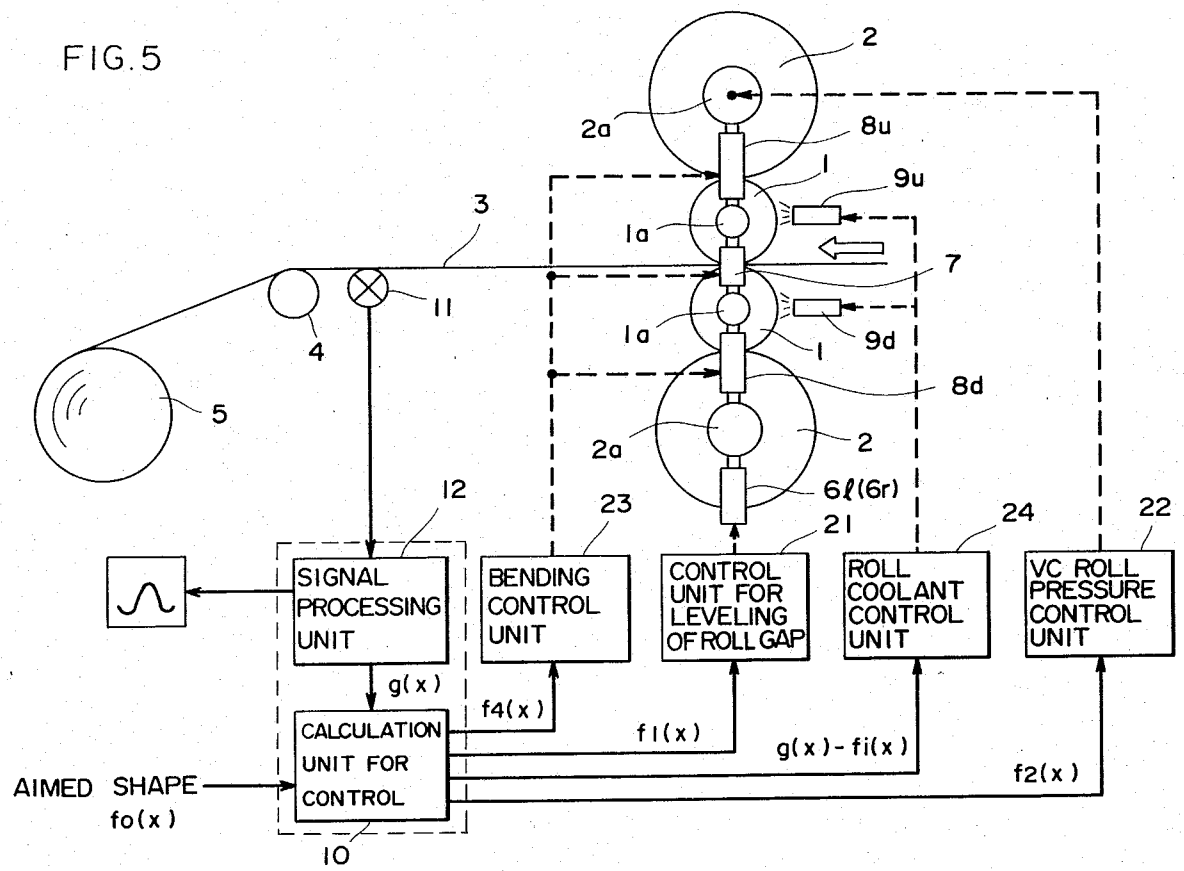
FIG. 5 is a schematic view showing a controlling apparatus of the present invention.

The preferred embodiment of the present invention will be concretely described below with reference to the drawings. Referring to FIG. 5, which is a schematic view showing the state in which a method of controlling the strip shape of the present invention is carried out by the use of an apparatus for controlling the strip shape of the present invention, 1, 1 designate work rolls, 2, 2 designating back-up rolls using variable crown sleeve rolls, in short, a VC roll therein, and 3 designating a strip to be rolled such as steel strip or nonferrous metal strip. The strip to be rolled is passed through the work rolls 1, 1 of a rolling mill from the direction shown by the white arrow and wound around a reel 5 via a guide roll 4.

The back-up rolls 2, 2 are adapted to expand or shrink the sleeve as a shell thereof by feeding a pressurized oil in the space between an axis portion of roll and the sleeve of roll concentrically arranged outside the axis portion of roll through the inside of the axis portion of roll so that an amount of the crown of a roll may be set and adjusted. Independently driven and controlled pressing-down apparatus 6*l*, 6*r*, which adjust the leveling of roll gap between the work roll 1 and 1, are provided at both ends (only one side end is shown in the drawing) of an axis 2*a* of the back-up roll 2 positioned below a pass line, independently driven and controlled roll benders 7, 8*u*, 8*d* being provided between axes 1*a*, 1*a* of the work rolls 1, 1 as well as between each of the work rolls 1, 1 and axes 1*a*, 2*a* of the back-up rolls 2, 2, respectively, and a plurality of nozzles 9*u*, 9*u* . . . , 9*d*, 9*d* . . . of the roll cooling apparatus capable of separately injecting and stopping a coolant, for example water or the like, being arranged in parallel in the axial direction of the work rolls 1, 1 in an opposite relation to the circumference of the work rolls 1, 1.

The pressing-down apparatus 6*l*, 6*r* are adapted to change a roll gap in the axial direction of the work rolls 1, 1 to adjust an elongation in the width direction of the strip 3 to be rolled by adjusting the pressing-down quantity of both end portions—the right end portion and the left end portion—of the back-up roll 2, whereby correcting the strip shape. In addition, the roll benders 7, 8*u*, 8*d* are adapted to change the shape of work rolls 1, 1 to adjust an elongation at each portion in the width direction of the strip 3 to be rolled by making the axes 1*a*, 1*a* of the work rolls 1, 1 or the axes 1*a*, 2*a* of the work rolls 1, 1 and the back-up rolls 2, 2 approach to each other (in the decrease direction) or apart from each other (in the increase direction) operating a hydraulic cylinder, whereby correcting the strip shape.

10 designates a calculation unit for control and is adapted to read-in a signal detected by a shape meter 11, for example, manufactured by Davy Mckee Ltd. disposed at the outlet side of a rolling mill at the predetermined timing through a signal processing unit 12, approximating the strip shape by a power function $f_i(x)$ including a term of the first power, a term of the second power and a term of the fourth, sixth or eighth power as shown by the equation (3) on the basis of the detected signal, expressing also the predetermined aimed shape by a power function $f_o(x)$ including a term of the first power, a term of the second power and a term of the fourth, sixth or eighth power likewise, calculating a pressing-down quantity of each pressing-down balancer 6*l*, 6*r*, an oil-pressure of VC roll 2, 2 and an oil-pressure of roll benders 7, 8*d*, 8*u* necessary for making both power functions coincide with each other, that is to say, making $B_i$ coincide with $B_o$, $C_i$ with $C_o$ and $D_i$ with $D_o$, calculating the opening and closing or the opening degree of each nozzle 9*u*, 9*u* . . . and 9*d*, 9*d* . . . of the roll cooling apparatus necessary for elimination of the difference between g(x) and $f_i(x)$, and putting out a controlling signal to each of control units 21, 22, 23, 24.

Figure 6:
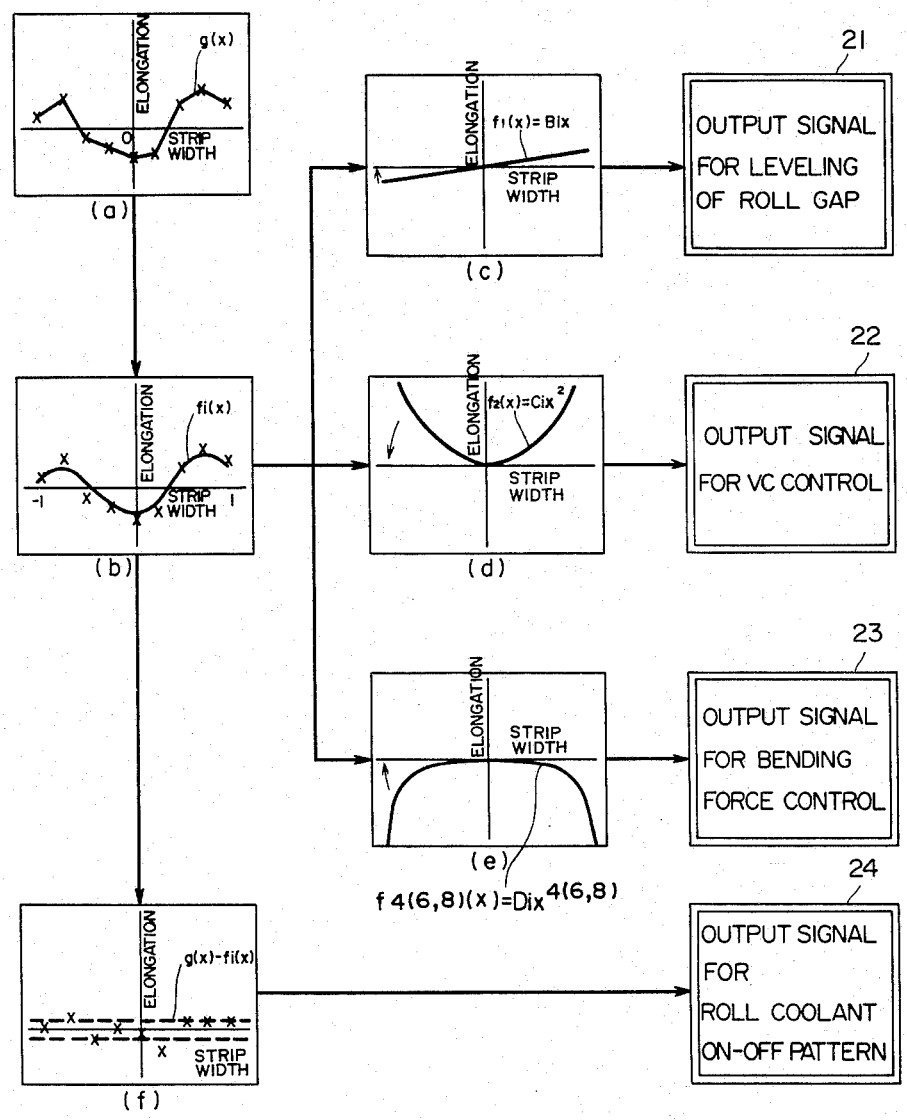
FIG. 6 is a general view showing a controlling method of the present invention.

FIG. 6 is a general view showing a shape-controlling process of the method of the present invention as described above. At first, provided that the strip shape in the width direction detected by the shape meter 11 has such a form as shown in FIG. 6(*a*) (expressed by g(x)), it is approximated by a function $f_i(x)$ as shown in FIG. 6(*b*) similarly taking a strip width on an axis of abscissas and an elongation on an axis of ordinate. This function $f_i(x)$ is expressed by a power function obtained by summing up a component of the first power $f_1(x)=B_ix$, a component of the second power $f_2(x)=C_ix^2$ and a component of the fourth, sixth or eighth power, for example, $f_{4(6,\ 8)}=D_ix^{4(6,\ 8)}$ alike to a graph shown in FIGS. 6(*c*), 6(*d*) and 6(*e*) taking the position in the direction of width from the strip width on an axis of abscissas and an elongation on an axis of ordinate, comparing the function $f_i(x)$ with the power function $f_o(x)$ such as the equation (4) expressing the predetermined aimed shape, putting out a controlling signal to each of the control units 21, 22, 23 of the pressing-down balancers 6*l*, 6*r*, the VC rolls 2, 2 and the roll benders 7, 8*d*, 8*u* to coincide the term of the first power $B_i$ with $B_o$, the term of the second power $C_i$ with $C_o$, and the term of the fourth, sixth or eighth power $D_i$ with $D_o$, calculating the difference between $f_1(x)$ and g(x) as shown by a graph drawn separately in FIG. 6(*f*) taking the strip width on an axis of abscissas and an elongation on an axis of ordinate, and putting out a signal to the roll coolant control unit 24 of the roll cooling apparatus to eliminate the difference between $f_1(x)$ and g(x), whereby carrying out the control.

Then, the control for the complex shape defect carried out by the combined adjustment of the VC rolls used as back-up rolls 2, 2 and roll benders 7, 8*d*, 8*u* will be described with giving concrete numerical values.

Figure 7B:
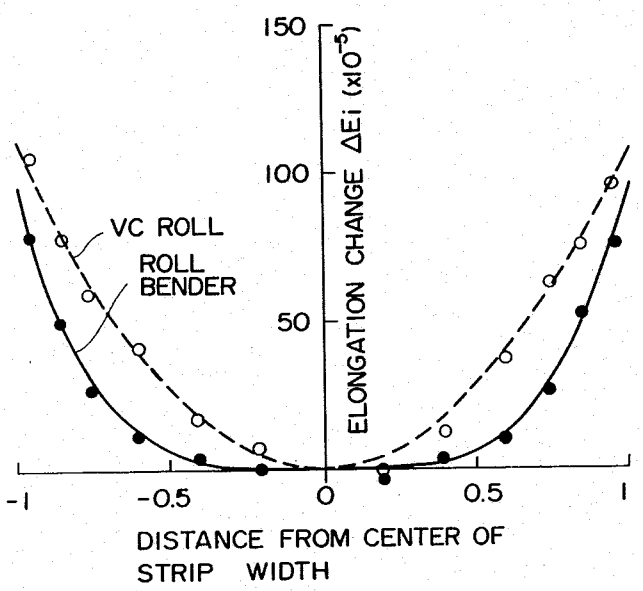
FIG. 7 is a graph showing an elongation change of a variable crown roll and a roll-bender used in the test.
Figure 7A:
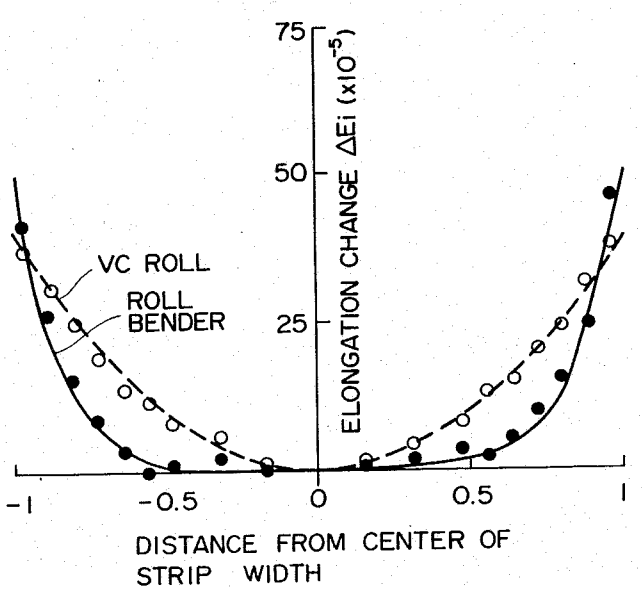

An elongation change characteristic of the VC roll and the roll bender used is shown in FIG. 7(*a*) and FIG. 7(*b*), respectively. FIG. 7(*a*) shows the results obtained in the process of rolling a pure aluminium strip having a width of 1150 mm and a thickness of 1.90 mm at the inlet side to a thickness of 0.095 mm at the outlet side while FIG. 7(*b*) shows the results obtained in the process of rolling a pure aluminium strip having a width of 1510 mm and a thickness of 1.90 mm at the inlet side to a thickness of 0.095 mm at the outlet side. In both cases, a distance from center of strip width is shown on an axis of abscissas and an elongation change (x $10^{-5}$) is shown on an axis of ordinate. The results of the VC roll are shown by ○ marks and those of the roll bender are shown by ● marks in the graph.

Figure 8A:
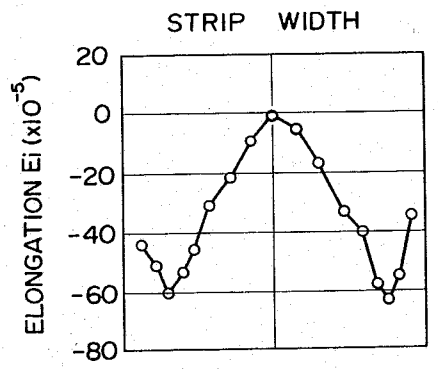
FIG. 8 is a graph showing a transition of elongation of a strip used in the test.
Figure 8B:
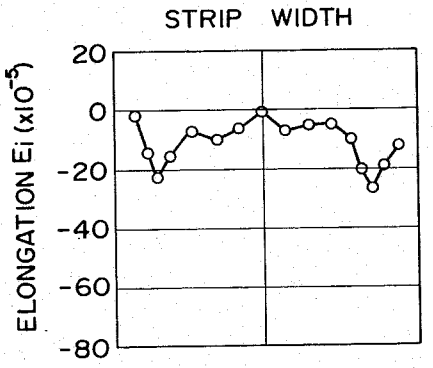
Figure 8C:
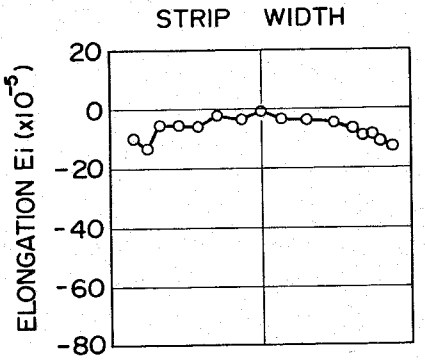
Figures 9A, 9B, 9C:
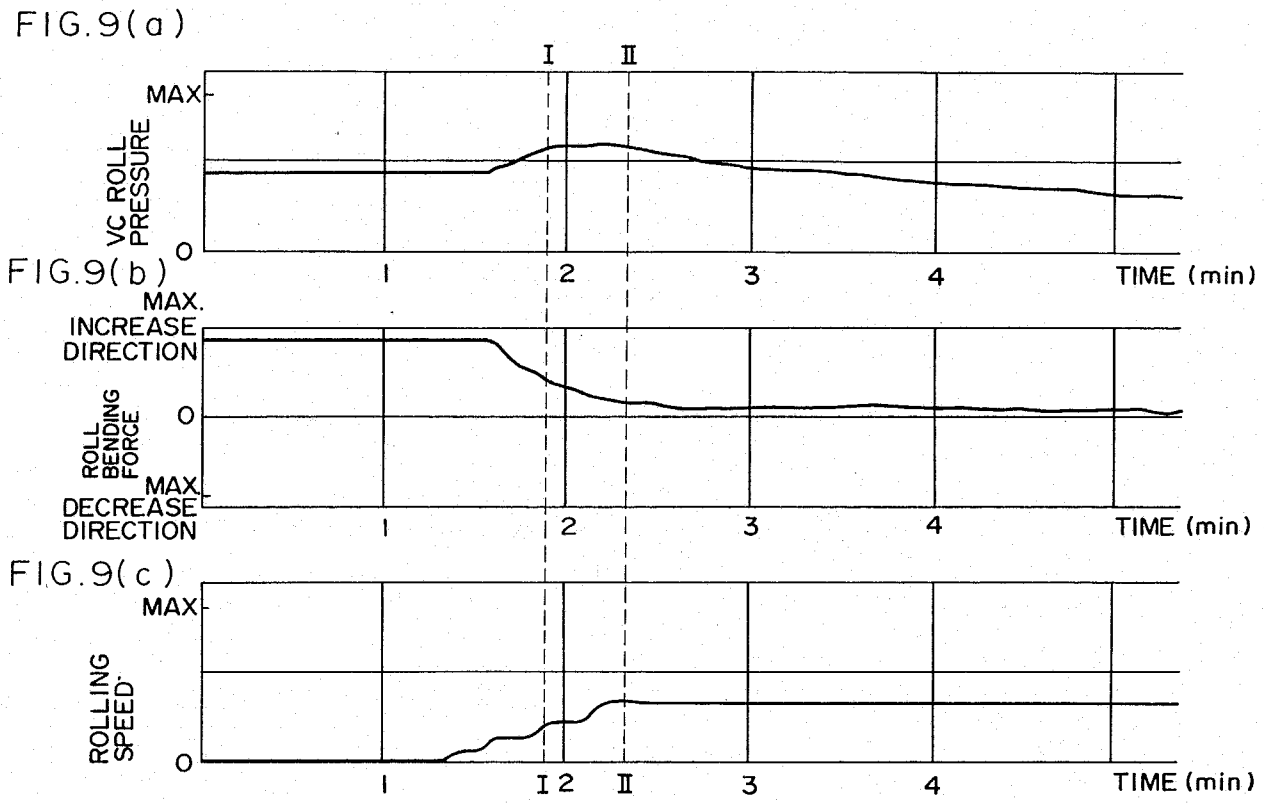
FIG. 9 is a time chart showing a pressure being given to a variable crown roll in the test, a roll bending force and a rolling speed.

The shape control was applied to a strip having an elongation as shown in FIG. 8(*a*) by the use of VC rolls and roll benders having an elongation change as described above. In FIG. 8(*a*), the strip width from the strip width center is shown on an axis of abscissas and an elongation $E_i$ (see FIG. 4) is shown on an axis of ordinate. As obvious from FIG. 8(*a*), a general complex shape defect is produced in the strip. That is to say, an elongation is increased toward both side portions in the direction of width from the strip width center reaching the maximum value at both quarter portions and slightly reduced at both side edge portions in comparison with the maximum value. An oil pressure of the VC roll, a roll bending force of the roll bender and a rolling speed were controlled for such a strip under the controlling condition as shown in FIGS. 9(*a*), 9(*b*) and 9(*c*). The oil pressure of the VC roll, the oil pressure of the roll bender (that in the direction of increase the gap between work rolls, that is to say, in the increase direction in the upper side and that in the direction of decrease the gap between work rolls, that is to say, in the decrease direction in the lower side) and the rolling speed is shown on an axis of ordinate in FIGS. 9(*a*), 9(*b*) and 9(*c*), respectively, and time is shown on an axis of abscissas in all FIGS. 9(*a*), 9(*b*) and 9(*c*).

As obvious from FIGS. 9(*a*), 9(*b*) and 9(*c*), the component of the second power of the elongation and the component of the fourth power of the elongation as shown in FIG. 8(*a*) was independently controlled by means of the VC roll and the roll bender, respectively, to coincide the component of the second power and the fourth power of the elongation with the target value, respectively, by slightly increasing the oil pressure of the VC roll from that in the stationary condition and then gradually reducing it taking the thermal expansion due to the contact with the strip into consideration and gradually reducing the oil pressure of the roll bender from that in the initial condition where the maximum oil pressure was given in the increasing direction. In addition, the rolling speed is stepwise increased and then kept constant.

The results of the above described shape control are shown in FIGS. 8(*b*) and 8(*c*). FIG. 8(*b*) and FIG. 8(*c*) show an elongation at the position shown by the line I—I and the line II—II in FIG. 9, respectively. In both FIG. 8(*b*) and FIG. 8(*c*), the position of strip width is shown on an axis of abscissas and an elongation is shown on an axis of ordinate. As obvious from FIGS. 8(*b*) and 8(*c*), as a result of increasing an elongation at the position shown by the line I—I in comparison with the strip width center an elongation at the central portion and both the edge portions are reduced until such an extent that it hardly changes and only both the quarter portions are still under the condition that an elongation is slightly large. Furthermore, at the position shown by the line II—II also an elongation of both the quarter portions were remarkably reduced and an elongation of the portion nearly both the edge portions became slightly larger than that of the strip width center, whereby the shape was controlled to an almost aimed strip shape.

In addition, although the construction, in which all of right and left pressing-down balancers, VC rolls as back-up rolls, roll benders and a roll-cooling apparatus provided in a four-roll type rolling mill are used, is disclosed in the above described preferred embodiment, the VC roll may be combined with at least one of other controlling elements such as a roll bender and right and left pressing-down balancers.

Furthermore, although the construction, in which a variable crown roll, that is to say, a VC roll was used as the upper and lower back-up rolls, was disclosed in the above described preferred embodiment, the construction, in which the VC roll is used as only one of the upper and lower back-up rolls, may be adopted.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. A method of controlling width-wise shape of a strip according to a predetermined shape, said strip rolled by a rolling mill of the type provided with back-up rolls, whose amount of the crown is variable by expanding or shrinking its shell radially using pressure of a liquid fed into the inside thereof, right and left pressing-down balancers and roll benders, said method comprising the steps of:

operating said rolling mill to form a strip;

generating a first power function indicating the predetermined strip shape, said first power function being of a variable which is a distance in a width-wise direction from a selected location on such strip and including a term of the first power, a term of the second power and a term of at least one of the fourth, sixth and eighth powers of said variable, repetitively generating a signal indicating a strip shape rolled by said rolling mill, said generated signal including readings of strip shape at preselected distances in a width-wise direction from the selected location on the strip;

obtaining a second power function approximating the generated signal, said second power function being of a variable which is a distance in a width-wise direction from the selected location on the strip and including a term of the first power, a term of the second power and a term of at least one of the fourth, sixth and eighth powers of said variable;

adjusting the amount of right and left pressing-down of said right and left pressing-down balancers so that said term of the first power of said second power function accords with said term of the first power of said first power function;

adjusting the amount of the crown of said back-up roll so that said term of the second power of said second power function accords with said term of the second power of said first power function; and adjusting the roll bending force of said roll bender so that said term of at least one of the fourth, sixth and eighth powers of said second power function accords with said term of at least one of the fourth, sixth and eighth powers of said first power function.

2. A method of controlling width-wise shape of a strip according to a predetermined shape, said strip rolled by a rolling mill of the type provided with back-up rolls, whose amount of the crown is variable by expanding or shrinking its shell radially using pressure of a liquid fed into the inside thereof, work rolls, right and left pressing-down balancers, roll benders and a roll cooling apparatus, said method comprising the steps of:

operating said rolling mill to form a strip with a width;

generating a first power function indicating the predetermined strip shape, said first power function being of a variable which is a distance in a width-wise direction from a selected location on such strip and including a term of a first power, a term of the second power and a term of at least one of the fourth, sixth and eighth powers of said variable, repetitively generating a signal indicating strip shape rolled by said strip mill, said generated signal including readings of strip shape at preselected distances in a width-wise direction from the selected location on the strip;

obtaining a second power function approximating the generated signal, said second power function being of a variable which is a distance in a width-wise direction from the selected location on the strip and including a term of the first power, a term of the second power and a term of at least one of the fourth, sixth and eighth powers of said variable;

adjusting the amount of right and left pressing-down of said right and left pressing-down balancers so that said term of the first power of said second power function accords with said term of the first power of said first power function;

adjusting the amount of the crown of said back-up roll so that said term of the second power of said second power function accords with said term of the second power of said first power function;

adjusting the roll bending force of said roll bender so that said term of at least one of the fourth, sixth and eighth powers of said second power function accords with said term of at least one of the fourth, sixth and eighth powers of said first power function; and compensating for deviation of the second power function from the generated signal by cooling said work rolls at locations along said work rolls according to differences between values of said second power function and readings of said generated signal at said preselected distances.

3. An apparatus for controlling width-wise shape of a strip according to a predetermined shape, said strip rolled by a rolling mill of the type provided with work rolls, said apparatus comprising:

roll benders operatively connected to rolls of said rolling mill;

variable crown back-up rolls backing-up said work rolls, the roll crown of said back-up rolls being adjusted by pressure of a liquid fed into the inside thereof;

shape meter means disposed at a location along a feed path of said rolling mill for generating a signal indicating the strip shape;

calculation means operatively connected to said shape meter means for obtaining a power function approximating the generated signal from said shape meter means, said power function being of a variable which is a distance in a width-wise direction from a selected location on such strip and including a term of the second power and a term of at least one of the fourth, sixth and eighth powers of said variable; and means operatively connected to said roll benders and said back-up rolls for controlling operation of said roll benders and said back-up rolls according to signals received from said calculation means, and said control means adjusting the roll crown of said back-up roll responsive to said term of the second power of said power function and said controlling means adjusting said roll-bender responsive to said term of at least one of the fourth, sixth and eighth powers of said power function.

4. An apparatus for controlling width-wise shape of a strip according to a predetermined shape, said strip rolled by a rolling mill of the type provided with work rolls, said apparatus comprising:

roll benders operatively connected to rolls of said rolling mill;

right and left pressing-down balancers operatively connected to rolls of said rolling mill;

variable crown back-up rolls backing-up said work rolls, the roll crowns of said back-up rolls being adjusted by pressure from a liquid fed into the inside thereof;

shape meter means disposed at a location along a feed path of said rolling mill for generating a signal indicating strip shape;

calculation means operatively connected to said shape meter means for obtaining a power function approximating the generated signal of said shape meter means, said power function being of a variable which is a distance in a width-wise direction from a selected location on such strip and including a term of the first power, a term of the second power and a term of at least one of the fourth, sixth and eighth powers of said variable; and means operatively connected to said roll benders, said right and left pressing-down balancers and said back-up rolls for controlling operation of said roll benders, said right and left pressing-down balancers and said back-up rolls, said controlling means adjusting said right and left pressing-down balancers responsive to said term of the first power of said power function, said controlling means adjusting the roll crown of said back-up roll responsive to said term of the second power of said power function and said controlling means adjusting said roll-bender responsive to said term of at least one of the fourth, sixth and eighth powers of said power function.

5. An apparatus for controlling width-wise shape of a strip rolled by a rolling mill of the type provided with work rolls, said apparatus comprising:

roll benders operatively connected to rolls of said rolling mill;

right and left pressing-down balancers operatively connected to rolls of said rolling mill;

a roll cooling apparatus operatively connected to work rolls of said rolling mill and adapted to cool locations along said work rolls;

variable crown back-up rolls backing-up said work rolls, the roll crowns of said back-up rolls being adjusted by pressure of a liquid fed into the inside thereof;

shape meter means disposed at a location along a feed path of said rolling mill for producing readings of strip shape at preselected distances in a width-wise direction from a selected location on the strip to generate a signal indicating strip shape;

calculation means operatively connected to said shape meter means for obtaining a power function approximating the signal of said shape meter means, said power function being of a variable which is a distance in a width-wise direction from the selected location on such strip and including a term of the first power, a term of second power, and a term of at least one of the fourth, sixth and eighth powers of said variable; and means operatively connected to said roll benders, said right and left pressing-down balancers, said back-up rolls and said roll cooling apparatus, for controlling operation of said roll benders, said right and left pressing-down balancers, said back-up rolls and said roll cooling apparatus, said controlling means adjusting said right and left pressing-down balancers responsive to said term of the first power of said power function, said controlling means adjusting the roll crown of said back-up roll responsive to said term of the second power of said power function, said controlling means adjusting the roll benders responsive to said term of at least one of the fourth, sixth and eighth powers of said power function, said controlling means adjusting said roll cooling apparatus responsive to differences between readings of said generated signal and values of said power function at said preselected distances to compensate for deviation of the shape expressed by the generated signal of said shape meter means from the shape expressed by said power function.

* * * * *